US007632157B2

(12) United States Patent
Imai

(10) Patent No.: US 7,632,157 B2
(45) Date of Patent: Dec. 15, 2009

(54) ELECTRICAL CONNECTOR

(75) Inventor: Toru Imai, Osaka (JP)

(73) Assignee: Hosiden Corporation, Osaka (JP)

( * ) Notice: Subject to any disclaimer, the term of this patent is extended or adjusted under 35 U.S.C. 154(b) by 0 days.

(21) Appl. No.: 12/283,650

(22) Filed: Sep. 12, 2008

(65) Prior Publication Data

US 2009/0075524 A1 Mar. 19, 2009

(30) Foreign Application Priority Data

Sep. 18, 2007 (JP) ..... 2007-240449

(51) Int. Cl.
*H01R 13/42* (2006.01)

(52) U.S. Cl. ..... 439/751

(58) Field of Classification Search ..... 439/751, 439/84, 842, 856, 857
See application file for complete search history.

(56) References Cited

U.S. PATENT DOCUMENTS 3,923,365 A * 12/1975 Lynch ..... 439/751
4,557,539 A * 12/1985 Zust et al. ..... 439/84
6,231,393 B1 5/2001 Lai
6,475,041 B1 * 11/2002 Lappohn et al. ..... 439/856

FOREIGN PATENT DOCUMENTS

| | | |
|---|---|---|
| DE | 34 41 416 | 5/1986 |
| EP | 0 144 128 | 6/1985 |
| EP | 1 418 646 | 5/2004 |
| EP | 1 801 936 | 6/2007 |
| JP | 11-251005 | 9/1999 |
| JP | 2004-158288 | 6/2004 |

OTHER PUBLICATIONS

Extended European Search Report issued Sep. 9, 2009 for corresponding European patent application No. 08016120.1.

* cited by examiner

*Primary Examiner*—Edwin A. Leon
(74) *Attorney, Agent, or Firm*—David N. Lathrop

(57) ABSTRACT

An electrical connector has a plurality of first contact pieces, each including a body portion, an arm portion extending from the body portion and a leg portion extending from the body portion, a plurality of second contact pieces, each including a body portion, an arm portion extending from the body portion and a leg portion extending from the body portion. The leg portion of each first contact piece is twisted at a right angle with respect to the body portion of the first contact piece and the leg portion of each second contact piece is twisted at a right angle with respect to the body portion of the second contact piece.

7 Claims, 21 Drawing Sheets

ELECTRICAL CONNECTOR

BACKGROUND OF THE INVENTION

1. Field of the Invention

The present invention relates to an electrical connector and more specifically to a narrow pitch electrical connector in which a plurality of contact pieces is juxtaposed to each other.

2. Description of the Related Art

An exemplary structure of a conventional electrical connector 900 will be explained first with reference to FIG. 1. Such an electrical connector is disclosed in Japanese Patent Application Laid-Open Nos. H11-251005 and 2004-158288 for example.

The electrical connector 900 includes a plurality of first contact pieces 910, a plurality of second contact pieces 920 not shown in FIG. 1, a contact supporting body 930 for holding the first and second contact pieces 910 and 920 and a lead supporting body 940 for holding leads 990.

<Contact Supporting Body>

As shown in FIGS. 2 and 3, the contact supporting body 930 formed of a single piece includes a body portion 931 in the form of a rectangular parallelepiped having a space portion 937 opened to the outside and a slot forming portion 932 in the form of a rectangular parallelepiped having two kinds of slots, i.e., a plurality of first slots 938*a* and a plurality of second slots 938*b*. The first and second slots 938*a* and 938*b* are alternately disposed in parallel at equal intervals. The respective slots 938*a* and 938*b* communicate with each other by a gap portion 936 opened to the outside. An inner wall 937*b* of the space portion 937 has linear grooves 937*a* that correspond to the respective slots 938*a* and 938*b*. The respective grooves 937*a* extend in an outside direction. The respective slots 938*a* and 938*b* communicate with the space portion 937 within the contact supporting body 930. The slot forming portion 932 is provided with concave portions 932*b* at both ends thereof. The first contact pieces 910 are inserted into the first slots 938*a* and the second contact pieces 920 are inserted into the second slots 938*b*, respectively. The first and second contact pieces 910 and 920 will be referred to simply as contact pieces hereinafter when they need not to be distinguished.

<First Contact Piece>

FIG. 4A is a front view of the first contact piece 910 and FIG. 4B is a side view thereof. In order to explain the first contact piece 910, a first contact plate 910*c* having a thin and long plate-like shape shown in FIG. 4C will be explained first. The first contact plate 910*c* formed of a single piece includes a body portion 911 of an L-shaped thin plate, an arm portion 912 of thin and long plate and a leg portion 913*c* of a thin and rectangular plate.

The arm portion 912 extends from one end portion of the body portion 911, and one end portion 912*a* of the arm portion 912 is widened. The leg portion 913*c* extends from the other end portion of the body portion 911. In the first contact plate 910*c* illustrated in the figure, a height H0 of the arm portion 912 near the other end portion thereof is lower than a height H1 of the body portion 911 around a boundary between the arm portion 912 and the body portion 911. A height H2 of a transition region from the leg portion 913*c* to the body portion 911 is higher than the height H1.

The first contact piece 910 shown in FIGS. 4A and 4B has a three-dimensional shape acquired by bending the leg portion 913*c* of the first contact plate 910*c* at a right angle. FIGS. 4A and 4B illustrate the shape thereof acquired by bending the leg portion 913*c* of the first contact plate 910*c* in a direction of the front side of the figure. The leg portion 913*c* of the first contact plate 910*c* corresponds to the leg portion 913 of the first contact piece 910.

<Second Contact Piece>

FIG. 5A is a front view of the second contact piece 920 and FIG. 5B is a side view thereof. In order to explain the second contact piece 920, a second contact piece plate 920*c* having a thin and long plate-like shape shown in FIG. 5C will be explained first. The second contact plate 920*c* formed of a single piece includes a body portion 921 of an L-shaped thin plate, an arm portion 922 of a thin and long plate and a leg portion 923*c* of a thin and rectangular plate. The arm portion 922 of the second contact plate 920*c* has the same shape with the arm portion 912 of the first contact plate 910*c*. The leg portion 923*c* of the second contact plate 920*c* has the same shape with the leg portion 913*c* of the first contact plate 910*c*. The body portion 921 of the second contact plate 920*c* has a shape obtained by turning the body portion 911 of the first contact plate 910*c* upside down.

The arm portion 922 extends from one end portion of the body portion 921, and one end portion 922*a* of the arm portion 922 is widened. The leg portion 923*c* extends from the other end portion of the body portion 921. In the second contact plate 920*c* illustrated in the figure, a height H0 of the arm portion 922 near the other end portion thereof is lower than a height H1 of the body portion 921 around a boundary between the arm portion 922 and the body portion 921. A height H2 of a transition region from the leg portion 923*c* to the body portion 921 is higher than the height H1. The respective heights H0, H1 and H2 shown in the figure of the second contact plate 920*c* are equal to those heights H0, H1 and H2 shown in the figure of the first contact plate 910*c*.

A difference of the second contact plate 920*c* from the first contact plate 910*c* is that while the leg portion 913*c* is provided at one side of a direction orthogonal to a longitudinal direction of the contact piece in the first contact plate 910*c*, the leg portion 923*c* is provided on the other side of the direction in the second contact plate 920*c*.

The second contact piece 920 shown in FIGS. 5A and 5B has a three-dimensional shape obtained by bending the leg portion 923*c* of the second contact plate 920*c* at a right angle. FIGS. 5A and 5B illustrate the shape thereof acquired by bending the leg portion 923*c* of the second contact plate 920*c* in the direction of the front side of the figure. The leg portion 923*c* of the second contact plate 920*c* corresponds to the leg portion 923 of the second contact piece 920.

<Inserting Contact Pieces>

As shown in FIG. 2, each of the first contact pieces 910 is inserted into the corresponding first slot 938*a* of the contact supporting body 930 with the arm portion 912 thereof in the lead. Each of the first contact pieces 910 is inhibited from excessively entering the contact supporting body 930, the leg portion 913 thereof contacting the slot forming surface 935 of the slot forming portion 932. The grooves 937*a* in the space portion 937 guide the arm portions 912 to store in the space portion 937.

Similarly, each of the second contact pieces 920 is inserted into the corresponding second slot 938*b* of the contact supporting body 930 with the arm portion 922 thereof in the lead. Each of the second contact pieces 920 is inhibited from excessively entering the contact supporting body 930, the leg portion 923 thereof contacting the slot forming surface 935 of the slot forming portion 932. The grooves 937*a* in the space portion 937 guide the arm portions 922 to store in the space portion 937.

The respective contact pieces are held so that insulation between the adjacent contact pieces is kept within the contact supporting body 930. Still more, an inner wall 939 of the contact supporting body 930 isolates the body portions of the adjacent contact pieces. FIG. 2 shows in a lower part of figure a construction in a state in which the first contact pieces 910 are inserted into the first slots 938*a* and the second contact pieces 920 are inserted into the second slots 938*b*. As shown in the figure, the leg portions 913 of the first contact pieces 910 are arrayed in a row in an upper deck of the contact supporting body 930 and the leg portions 923 of the second contact pieces 920 are arrayed in a row in a lower deck. In this state, the first contact pieces 910 and the second contact pieces 920 are arrayed in parallel so that the arm portions 912 and 922 overlap each other when the contact supporting body 930 is seen from the side (see FIG. 7).

<Lead Supporting Body>

FIG. 6A is a perspective view of the lead supporting body 940 and FIG. 6B is a back view thereof. The lead supporting body 940 formed of a single piece includes a body portion 945 in which a lead holding portion 941 having a plurality of grooves 941*a* into which the leads 990 are fitted is formed in a double-deck structure, two clip portions 943 extending from both ends of the body portion 945 in an extension direction of the grooves 941*a* and a plate-like table portion 942 extending from a center part 940*b* of the body portion 945. The two clip portions 943 extend in the same direction. An end of each clip portion 943 is bifurcated, and catch portions 943*b* are formed at the bifurcated ends. The table portion 942 is provided on the same side with the side where the respective clip portions 943 are provided. Part of the table portion 942 is tapered toward an end of each clip portion 943. This plays a role of leading the leg portions of the respective contact pieces toward the front of the lead holding portion 941 in assembling the lead supporting body 940 into the contact supporting body 930.

<Assembling Contact Supporting Body with Lead Supporting Body>

The lead supporting body 940 is assembled into the contact supporting body 930 as shown in FIG. 1. The clip portions 943 of the lead supporting body 940 fit into the concave portions 932*b* of the contact supporting body 930, and the catch portions 943*b* of the lead supporting body 940 catch on the slot forming portion 932 due to elasticity of the clip portions 943. It prevents the lead supporting body 940 from being disengaged from the contact supporting body 930. In the state in which the lead supporting body 940 is assembled with the contact supporting body 930, the leg portions 913 of the first contact pieces 910 are placed upon an upper surface of the table portion 942 of the lead supporting body 940 and leg portions 923 of the second contact pieces 920 are placed under an under surface (not shown in FIG. 1) of the table portion 942. Leads 990 are fitted into the grooves 941*a* of the lead holding portion 941, and each of the grooves 941*a* holds one lead 990. An unwrapped core portion 990*b* of each of the leads 990 is soldered to the leg portion 913 or 923 corresponding to the groove 941*a*.

The electrical connector is required to be miniaturized depending on their use. Consider here to lower a height of the lead supporting body 940. The height L0 (see FIG. 6B) of the lead supporting body 940 is a total of a height of the lead holding portion 941 with double-deck structure including the center part 940*b* of the body portion 945. The height of the lead holding portion 941 depends on outer diameters of the leads 990. It is then difficult to freely design and lower the height of the lead holding portion 941 because the outer diameter of the lead 990 is standardized in general. Meanwhile, the height of the center part 940*b* is determined by a distance L1 between the leg portions 913 and 923 as shown in FIG. 7. That is, the height of the lead supporting body 940 may be lowered by reducing the distance L1.

SUMMARY OF THE INVENTION

An object of the present invention is to provide a small type electrical connector.

An electrical connector according to the present invention comprises a plurality of first contact pieces, each including a body portion, an arm portion extending from the body portion and a leg portion extending from the body portion; a plurality of second contact pieces, each including a body portion, an arm portion extending from the body portion and a leg portion extending from the body portion; a contact supporting body for holding the first and second contact pieces alternately in parallel; and a lead supporting body, to be assembled to the contact supporting body, for holding a plurality of leads to be connected with the leg portions of the first contact pieces or the leg portions of the second contact pieces. The leg portion of each first contact piece is twisted at a right angle with respect to the body portion of each first contact piece and the leg portion of each second contact piece is twisted at a right angle with respect to the body portion of each second contact piece.

EFFECTS OF THE INVENTION

According to the invention, because the leg portion of each first contact piece is twisted at a right angle with respect to the body portion of the first contact piece and the leg portion of each second contact piece is twisted at a right angle with respect to the body portion of the second contact piece, the height of the lead supporting body may be lowered, thus realizing the miniaturized electrical connector.

DETAILED DESCRIPTION OF THE EMBODIMENTS

First Embodiment

Figure 1:
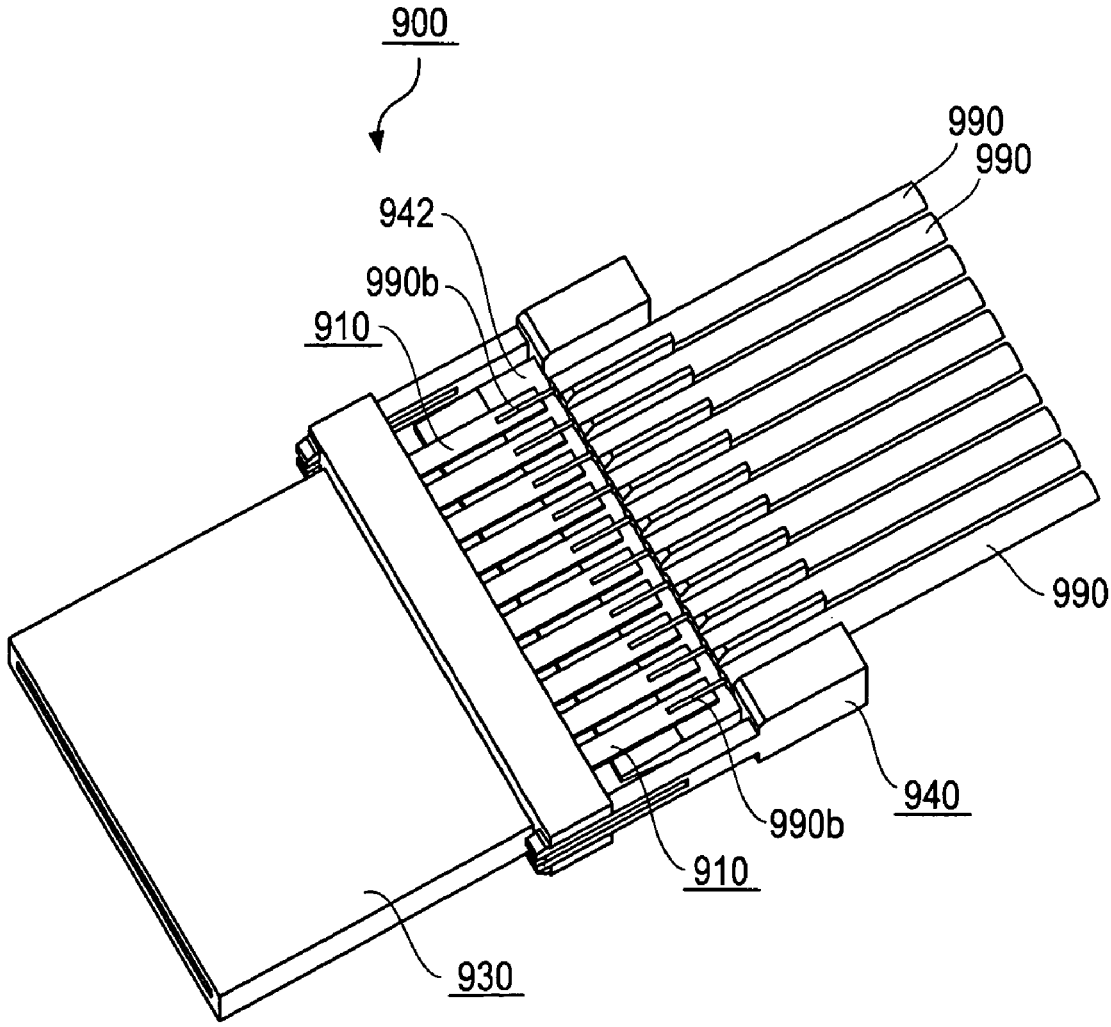
FIG.1 PRIOR ART
FIG. 1 is a perspective view of a conventional electrical connector.
Figure 2:
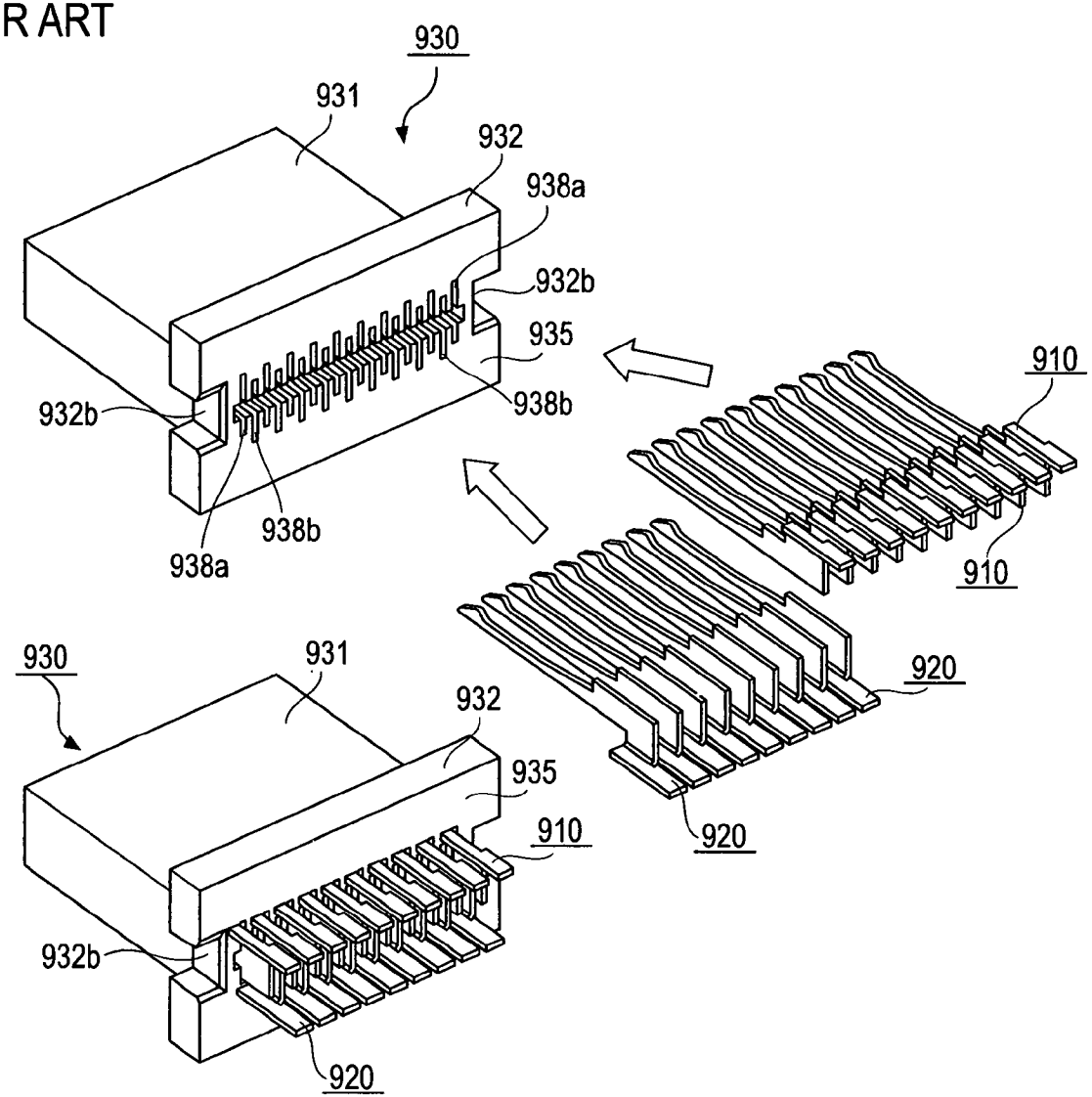
FIG.2 PRIOR ART
FIG. 2 is a perspective view for explaining that first and second contact pieces are inserted into a contact supporting body of the conventional electrical connector shown in FIG. 1.
Figure 3:
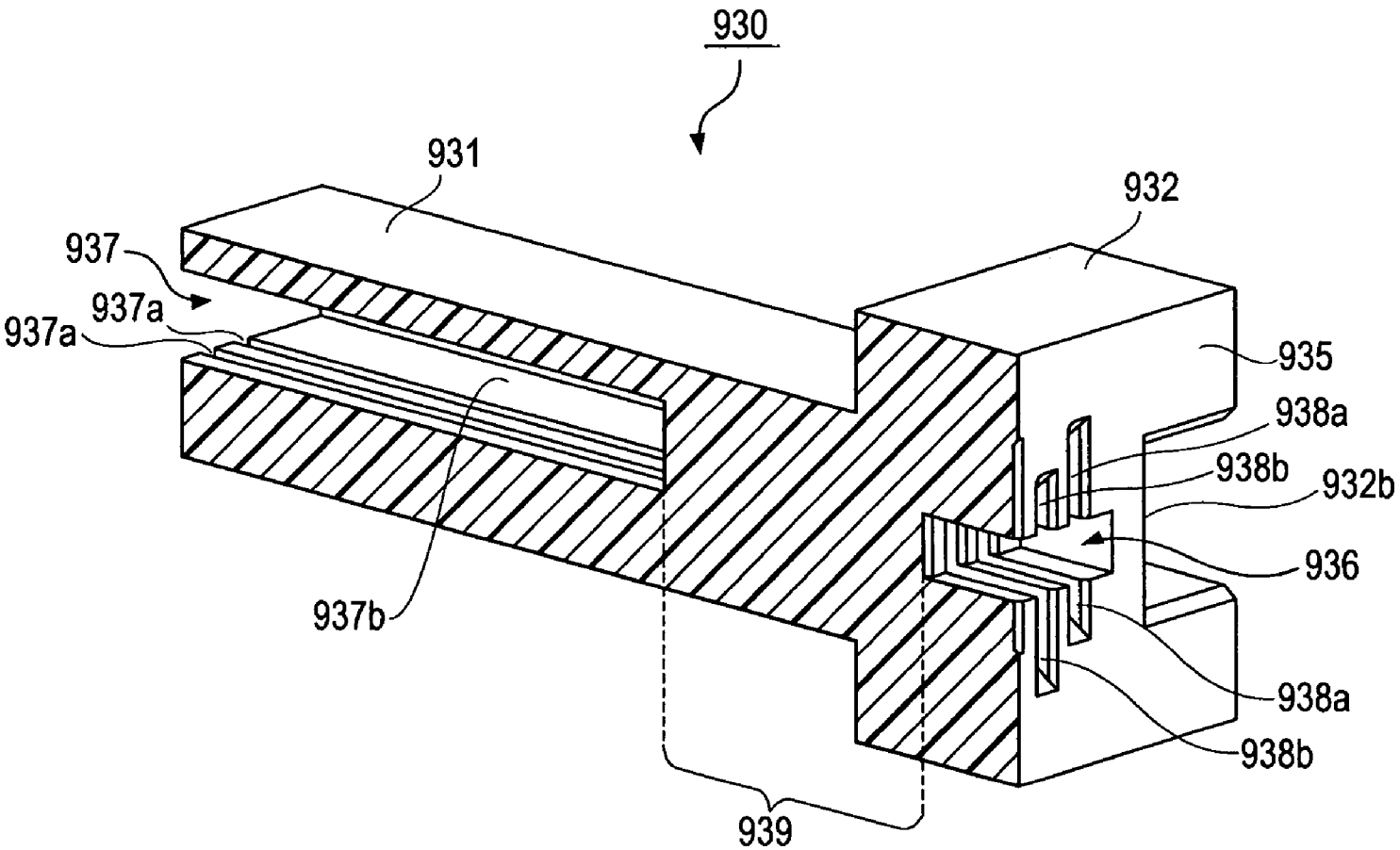
FIG.3 PRIOR ART
FIG. 3 is a sectional perspective view of the contact supporting body of the conventional electrical connector shown in FIG. 1.
Figure 4A:
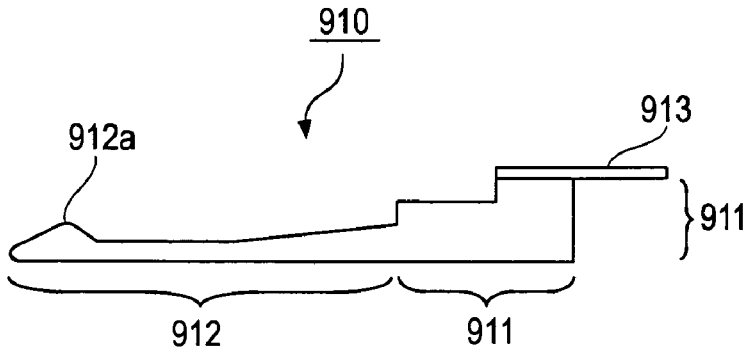
FIG.4A PRIOR ART
FIG. 4A is a front view of a first contact piece used in the conventional electrical connector shown in FIG. 1.
Figure 4B:
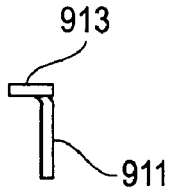
FIG.4B PRIOR ART
FIG. 4B is a side view of the first contact piece shown in FIG. 4A.
Figure 4C:
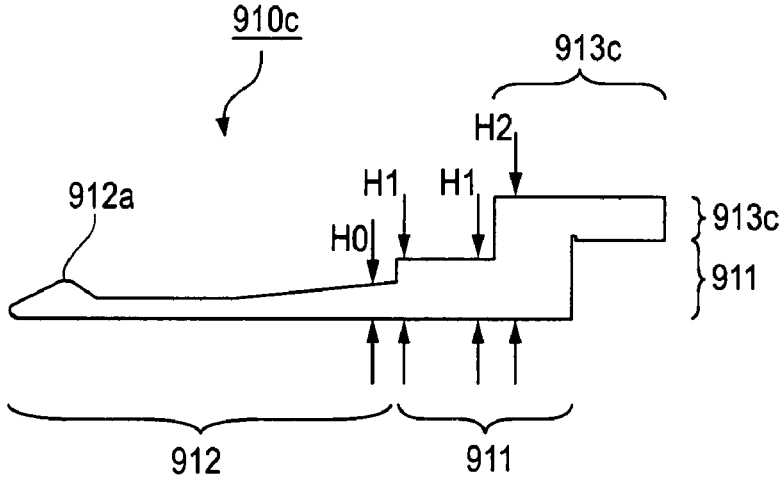
FIG.4C PRIOR ART
FIG. 4C is a front view of a first contact plate 910*c* for explaining the first contact piece shown in FIG. 4A.
Figure 5A:
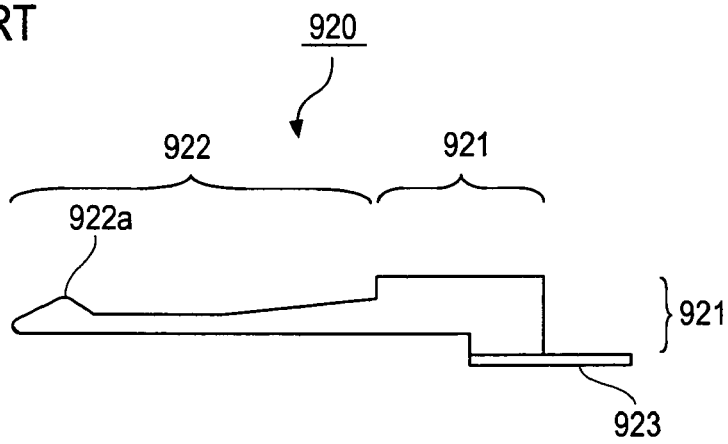
FIG.5A PRIOR ART
FIG. 5A is a front view of a second contact piece used in the conventional electrical connector shown in FIG. 1.
Figure 5B:
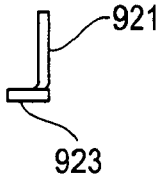
FIG.5B PRIOR ART
FIG. 5B is a side view of the second contact piece shown in FIG. 5A.
Figure 5C:
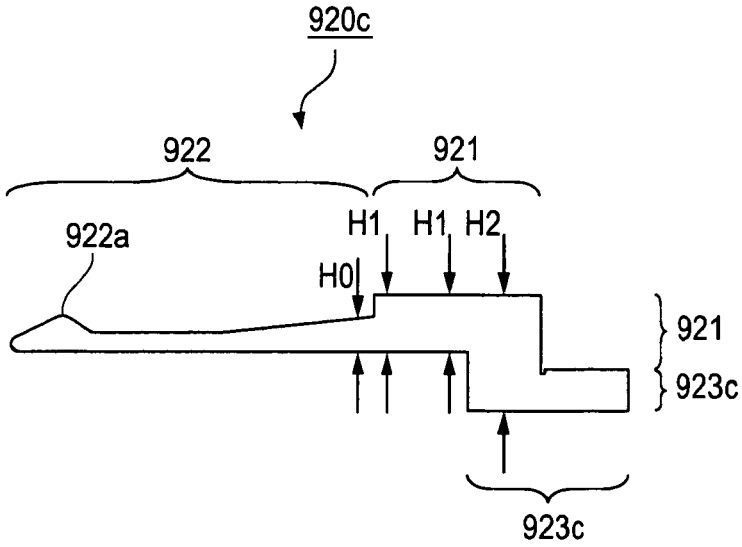
FIG.5C PRIOR ART
FIG. 5C is a front view of a second contact plate for explaining the second contact piece shown in FIG. 5A.
Figure 6A:
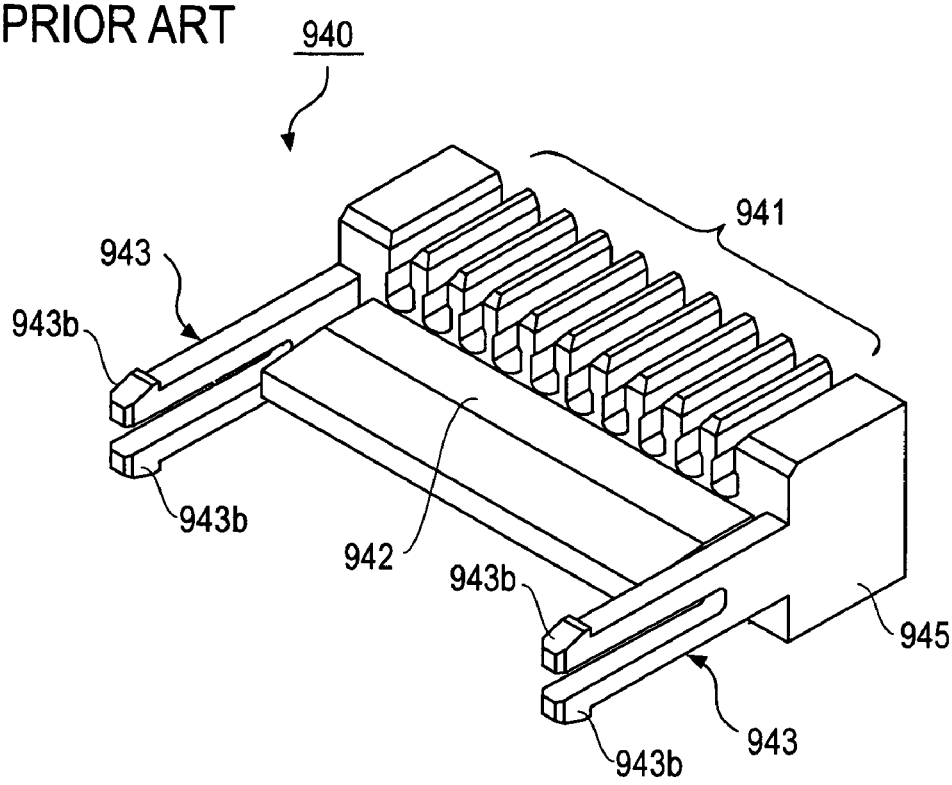
FIG.6A PRIOR ART
FIG. 6A is a perspective view of a lead supporting body of the conventional electrical connector shown in FIG. 1.
Figure 6B:
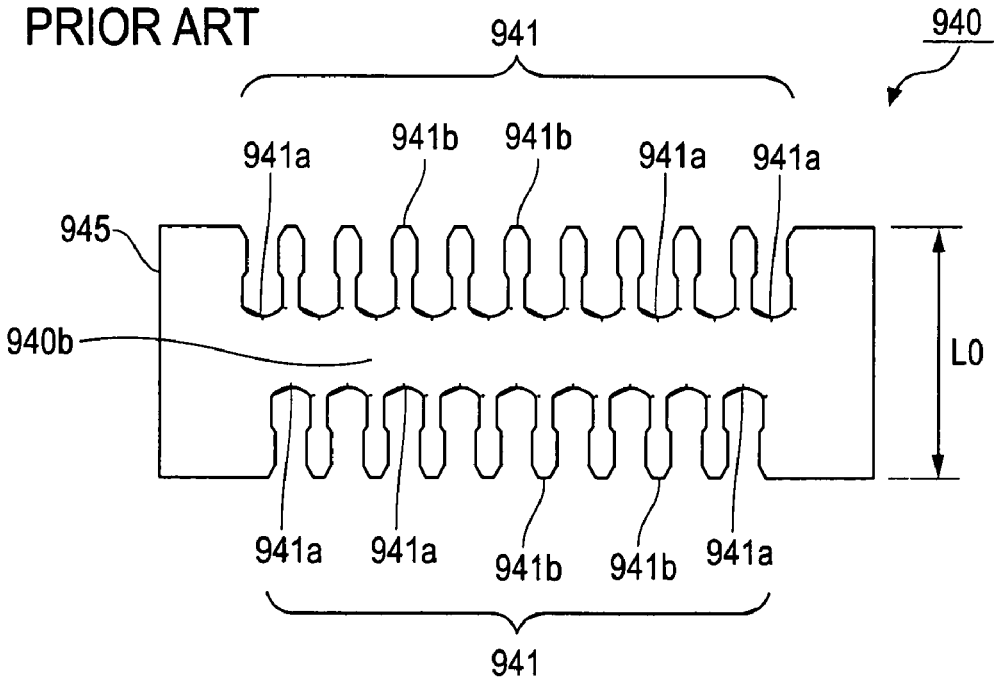
FIG.6B PRIOR ART
FIG. 6B is a back view of the lead supporting body shown in FIG. 6A.

An electrical connector of a first embodiment of the invention will be explained below with reference to the drawings. The electrical connector 100 has first contact pieces 110, second contact pieces 120, a contact supporting body 930 and a lead supporting body 940. The contact supporting body 930 and the lead supporting body 940 have the same structures with those explained in the Background of the Invention, so that their explanation will be omitted here. The first and second contact pieces 110 and 120 will be referred to simply as contact pieces hereinafter when they need not to be distinguished.

<First Contact Piece>

Figure 8A:
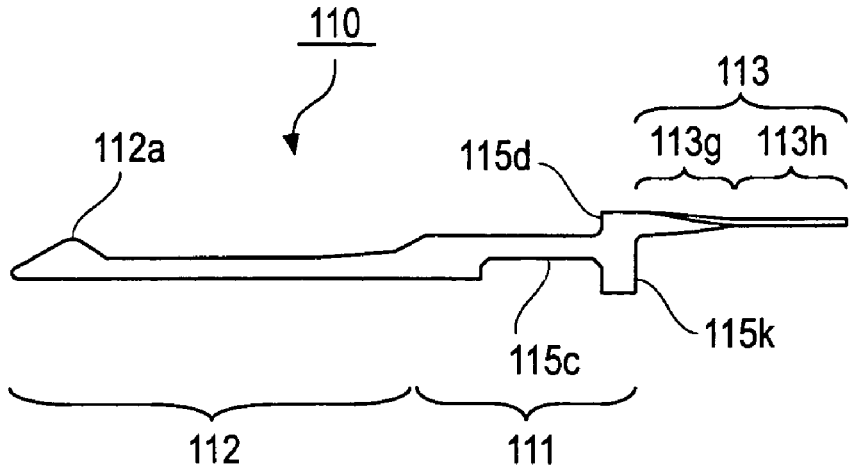
FIG. 8A is a front view of a first contact piece according to a first embodiment of the invention.
Figure 8B:
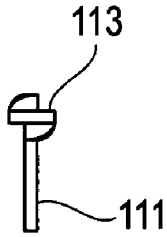
FIG. 8B is a side view of the first contact piece shown in FIG. 8A.
Figure 8C:
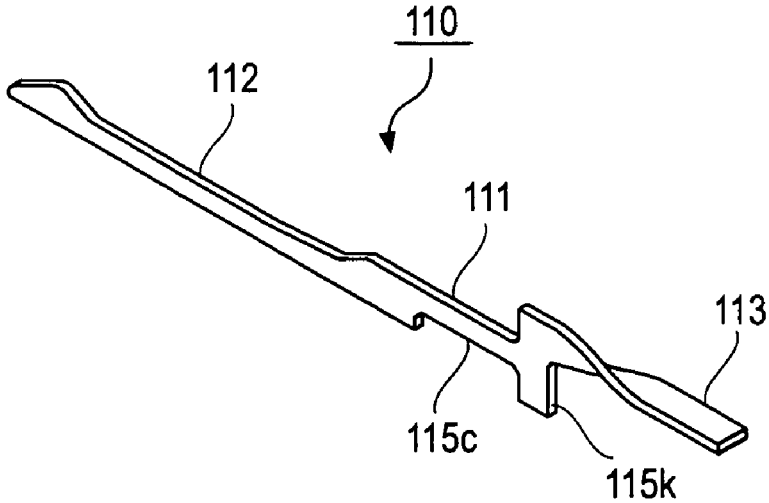
FIG. 8C is a perspective view of the first contact piece shown in FIG. 8A.

FIG. 8A is a front view of the first contact piece 110, FIG. 8B is a side view thereof and FIG. 8C is a perspective view thereof. In order to explain the first contact piece 110, a first contact plate 110*c* having a thin and long plate-like shape will be explained first with reference to FIG. 8D. The first contact plate 110*c* formed of a single piece includes a body portion 115 of a thin plate and an arm portion 112 of a thin and long plate.

The body portion 115 has a shape resembling that which is obtained by joining a rectangular thin plate 115*a* and a rectangular thin plate 115*b* shifted along long side of the rectangular thin plate 115*a*. In other words, the body portion 115 is formed into the shape of Z. Considering that the first contact plate 110*c* is an integrally formed piece, the names of the rectangular thin plates 115*a* and 115*b* will be changed to rectangular thin plate portions 115*a* and 115*b* hereinafter. The rectangular thin plate portion 115*a* positioned at lower part of the body portion 115 has a cutout portion 115*c*. The rectangular cutout portion 115*c* illustrated in the figure is formed from the long side on the downside of the rectangular thin plate portion 115*a* to a long side on the upside of that and has a height of about a half of a height H3 of the rectangular thin plate portion 115*a*. A horizontal width of the cutout portion 115*c* is about a half of a horizontal width of the rectangular thin plate portion 115*a*.

The arm portion 112 extends from a short side portion of the rectangular thin plate portion 115*a*, and one end portion 112*a* of the arm portion 112 is widened. This one end portion 112*a* becomes a contact point with a contact piece of a counterpart electrical connector not shown.

The first contact piece 110 shown in FIGS. 8A through 8C has a three-dimensional shape acquired by twisting, around an extension direction of the arm portion 112 (namely, the first contact piece 110), one end portion (the end portion further from the rectangular thin plate portion 115*a*) of the rectangular thin plate portion 115*b* positioned in an upper part of the body portion 115. FIGS. 8A through 8C illustrate the shape thereof acquired by twisting the rectangular thin plate portion 115*b* by 90 degrees so that the upper end portion of the rectangular thin plate portion 115*b* falls in front of the figure. The twisted portion corresponds to the leg portion 113 of the first contact piece 110. The portion not twisted of the body portion 115 corresponds to the body portion 111 of the first contact piece 110. That is, the first contact piece 110 includes the arm portion 112, the body portion 111 and the leg portion 113 twisted so as to be orthogonal to the body portion 111. The leg portion 113 includes a twist portion 113*g* and a rectangular thin plate portion 113*h* orthogonal to the body portion 111. It is noted that the first contact piece 110 is achieved by applying torsion process to the first contact plate 110*c* stamped out with a die by press working. An erosion resistant treatment is appropriately implemented on the surface of the first contact piece 110.

Figure 8D:
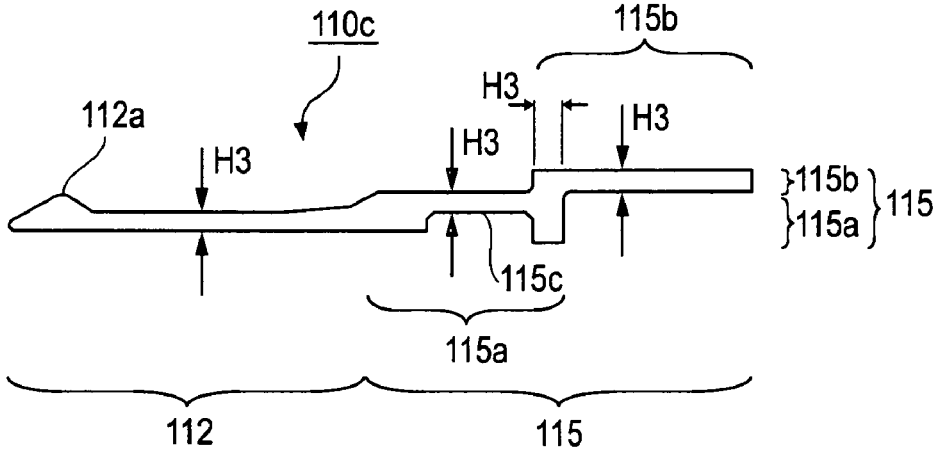
FIG. 8D is a front view of a first contact plate for explaining the first contact piece shown in FIG. 8A.

As it is apparent from the shape of the first contact plate 110*c* shown in FIG. 8D, the heights of the arm portion 112, the rectangular thin plate portion 115*a* and the rectangular thin plate portion 115*b* of the first contact piece 110 are almost the same H3. That is, a width of the first contact piece 110 in a direction vertical to a direction in which electrical signals advance through the first contact piece 110 (a longitudinal direction of the first contact piece 110) varies less. Due to that, parasitic capacitance (inductance and capacitance components) of the first contact piece 110 barely changes, realizing favorable transmission characteristics.

<Second Contact Piece>

Figure 9A:
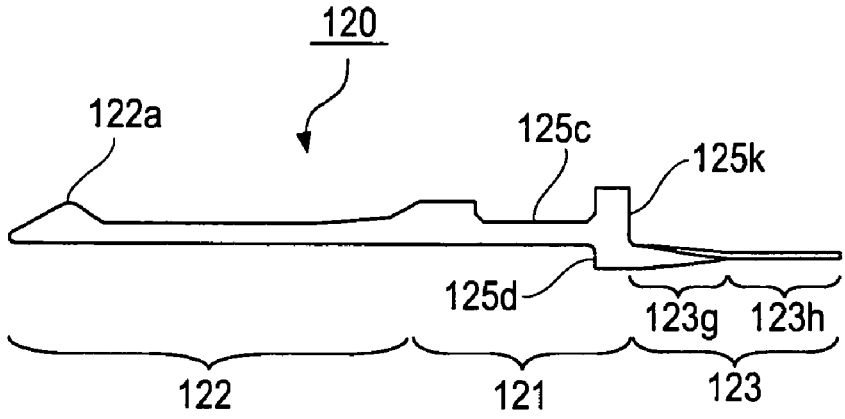
FIG. 9A is a front view of a second contact piece according to the first embodiment of the invention.
Figure 9B:
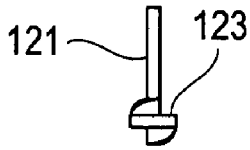
FIG. 9B is a side view of the second contact piece shown in FIG. 9A.
Figure 9C:
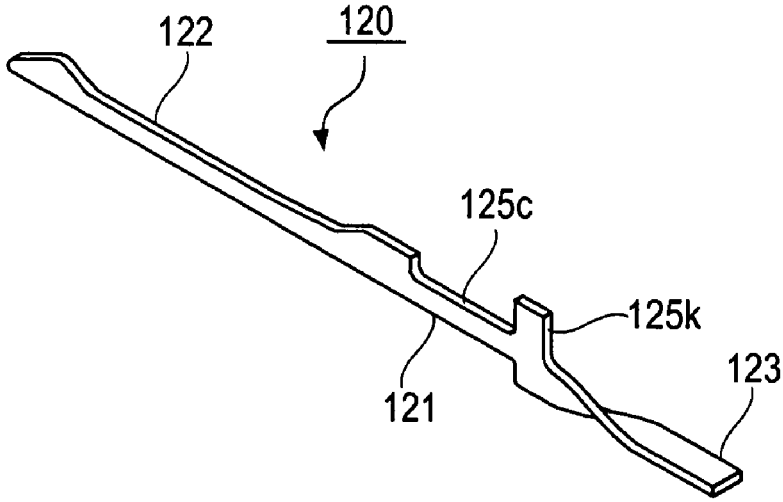
FIG. 9C is a perspective view of the second contact piece shown in FIG. 9A.

FIG. 9A is a front view of the second contact piece 120, FIG. 9B is a side view thereof and FIG. 9C is a perspective view thereof. In order to explain the second contact piece 120, a second contact plate 120*c* having a thin and long plate-like shape will be explained first with reference to FIG. 9D. The second contact plate 120*c* formed of a single piece has a body portion 125 of a thin plate, an arm portion 122 of a thin and long plate. The arm portion 122 of the second contact plate 120*c* has the same shape with the arm portion 112 of the first contact plate 110*c*. The body portion 125 of the second contact plate 120*c* has a shape obtained by turning the body portion 115 of the first contact plate 110*c* upside down.

The body portion 125 has a shape resembling that which is obtained by joining a rectangular thin plate 125*a* and a rectangular thin plate 125*b* shifted along long side of the rectangular thin plate 125*a*. In other words, the body portion 125 is formed into the shape of Z. Considering that the second contact plate 120*c* is an integrally formed piece, the names of the rectangular thin plates 125*a* and 125*b* will be changed to rectangular thin plate portions 125*a* and 125*b* hereinafter. The rectangular thin plate portion 125*a* positioned at upper part of the body portion 125 has a cutout portion 125*c*. The rectangular cutout portion 115*c* illustrated in the figure is formed from the long side on the downside of the rectangular thin plate portion 125*a* to a long side on the downside of that and has a height of about a half of a height H3 of the rectangular thin plate portion 125*a*. A horizontal width of the cutout portion 125*c* is about a half of a horizontal width of the rectangular thin plate portion 125*a*.

The arm portion 122 extends from a short side portion of the rectangular thin plate portion 125*a*, and one end portion 122*a* of the arm portion 122 is widened. This one end portion 122*a* becomes a contact point with a contact piece of a counterpart electrical connector not shown. Each height H3 shown in the figure of the second contact plate 120*c* is equal to each height H3 shown in the figure of the first contact plate 110*c*.

The second contact piece 120 shown in FIGS. 9A through 9C has a three-dimensional shape acquired by twisting, around an extension direction of the arm portion 122 (namely, the second contact piece 120), one end portion (the end portion further from the rectangular thin plate portion 125*a*) of the rectangular thin plate portion 125*b* positioned in a lower part of the body portion 125. FIGS. 9A through 9C illustrate the shape thereof acquired by twisting the rectangular thin plate portion 125*b* by 90 degrees so that the upper end portion of the rectangular thin plate portion 125*b* falls in front of the figure. The twisted portion corresponds to the leg portion 123 of the second contact piece 120. The portion not twisted of the body portion 125 corresponds to the body portion 121 of the second contact piece 120. That is, the second contact piece 120 includes the arm portion 122, the body portion 121 and the leg portion 123 twisted so as to be orthogonal to the body portion 121. The leg portion 123 includes a twist portion 123*g* and a rectangular thin plate portion 123*h* orthogonal to the body portion 121. It is noted that the second contact piece 120 is achieved by applying torsion process to the second contact plate 120*c* stamped out with a die by press working. An erosion resistant treatment is appropriately implemented on the surface of the second contact piece 120.

Figure 9D:
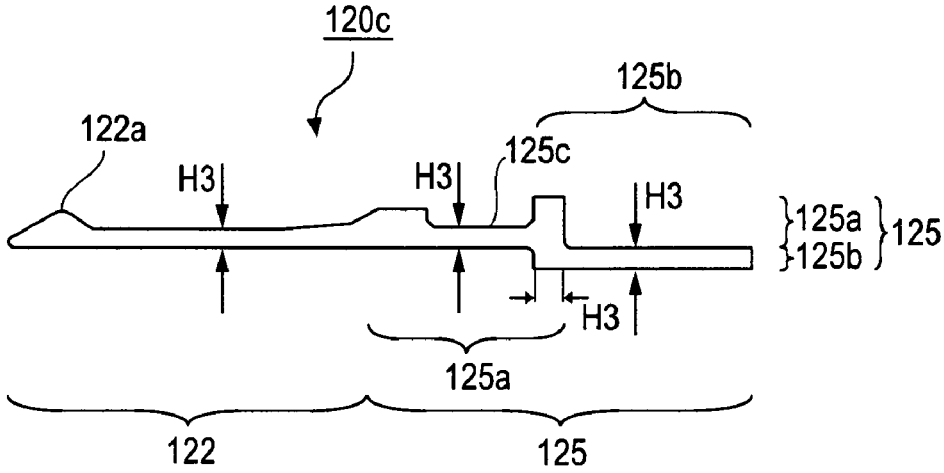
FIG. 9D is a front view of a second contact plate for explaining the second contact piece shown in FIG. 9A.

As it is apparent from the shape of the second contact plate 120*c* shown in FIG. 9D, the heights of the arm portion 122, the rectangular thin plate portion 125*a* and the rectangular thin plate portion 125*b* of the second contact piece 120 are almost the same H3. That is, a width of the second contact piece 120 in a direction vertical to a direction in which electrical signals advance through the second contact piece 120 (a longitudinal direction of the second contact piece 120) varies less. Due to that, parasitic capacitance (inductance and capacitance components) of the second contact piece 120 barely changes, realizing favorable transmission characteristics.

The first contact piece 110 is different from the second contact piece 120 in the following two points. (1) While the leg portion 113 is provided on one side in a direction vertical to a longitudinal direction of the contact piece in the first contact piece 110, the leg portion 123 is provided on another side thereof in the second contact piece 120, and (2) while the cutout portion 115*c* is provided on one side of the direction vertical to the longitudinal direction of the contact piece in the first contact piece 110, the cutout portion 125*c* is provided on another side thereof in the second contact piece 120.

<Inserting Contact Pieces>

Each of the first contact pieces 110 is inserted into the corresponding first slot 938*a* of the contact supporting body 930 with the arm portion 112 thereof in the lead. A height of a back of each first slot 938*a* is reduced, and each of the first contact pieces 110 is inhibited from excessively entering the contact supporting body 930, the short side portion 115*d* of the rectangular thin plate portion 115*b* thereof contacting the inner wall portion 939 of the contact supporting body 930. The grooves 937*a* in the space portion 937 guide the arm portions 112 to store in the space portion 937.

Similarly, each of the second contact pieces 120 is inserted into the corresponding second slot 938*b* of the contact supporting body 930 with the arm portion 122 thereof in the lead. A height of a back of each second slot 938*b* is reduced and each of the second contact pieces 120 is inhibited from excessively entering the contact supporting body 930, the short side portion 125*d* of the rectangular thin plate portion 125*b* thereof contacting the inner wall portion 939 of the contact supporting body 930. The grooves 937*a* in the space portion 937 guide the arm portions 122 to store in the space portion 937.

The respective contact pieces are held so that insulation between the adjacent contact pieces is kept within the contact supporting body 930. Still more, the inner wall portion 939 of the contact supporting body 930 isolates the body portions of the adjacent contact pieces.

Figure 10:
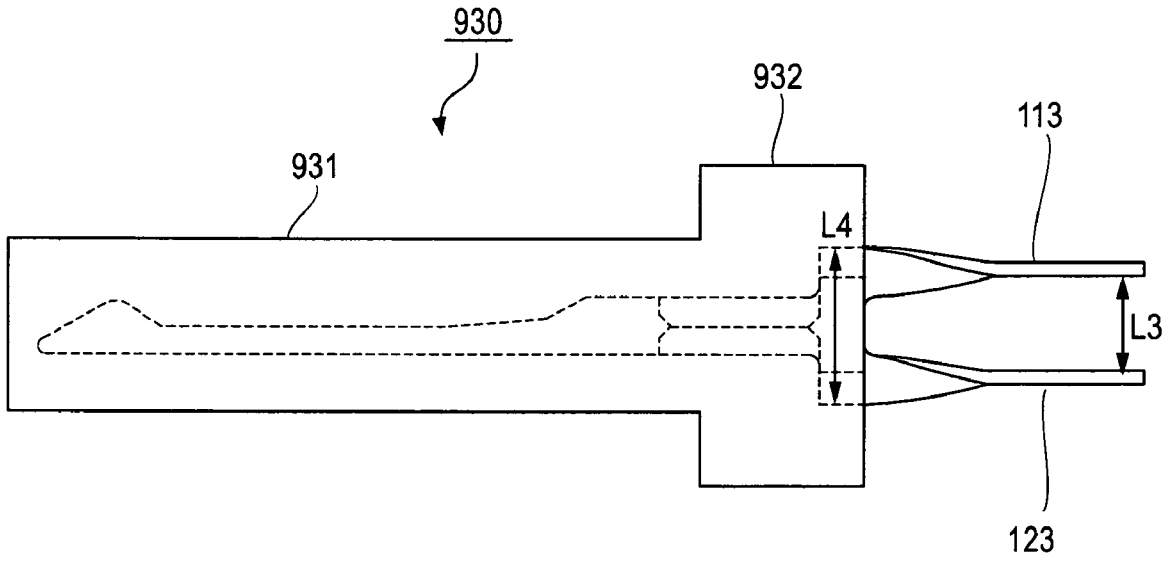
FIG. 10 is an illustration diagram for explaining a distance between a leg portion of the first contact piece and a leg portion of the second contact piece according to the first embodiment.

In a state in which the pluralities of first contact pieces 110 and second contact pieces 120 are inserted into the contact supporting body 130, the first contact pieces 110 and the second contact pieces 120 are juxtaposed in a row as shown in FIG. 10. That is, the first and second contact pieces 110 and 120 are arrayed in parallel so that plane portions of the arm portions 112 and 122 overlap each other when the contact supporting body 930 is seen from the side.

Figure 7:
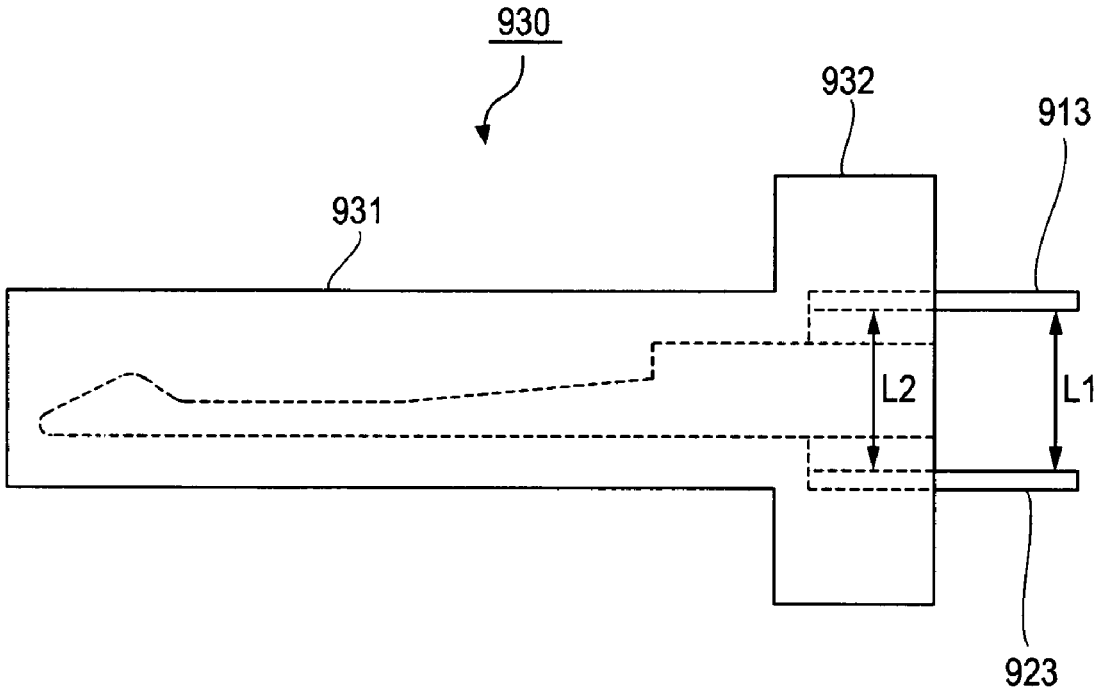
FIG.7 PRIOR ART
FIG. 7 is an illustration diagram for explaining a distance between a leg portion of the first contact piece and a leg portion of the second contact piece shown in FIG. 2.

A distance L3 between the leg portion 113 of the first contact piece 110 and the leg portion 123 of the second contact piece 120 is smaller than a maximum height L4 of the overlapped first and second contact pieces 110 and 120. Therefore, if the height L4 is equal to the height L2 shown in FIG. 7 (the maximum height of the overlapped first and second contact pieces 910 and 920), the distance L3 is shorter than the distance L1 shown in FIG. 7. Accordingly, the electrical connector 100 of the first embodiment may be miniaturized by lowering the height thereof as described above as compared to the conventional electrical connector 900.

Still more, the configuration of the electrical connector 100 of the first embodiment eliminates drawbacks involved in the miniaturization, as compared to the conventional electrical connector 900. In the state in which the first and second contact pieces 910 and 920 are mounted to the contact supporting body 930 of the conventional electrical connector 900, the first and second contact pieces 910 and 920 are juxtaposed in a row and face each other, except of the leg portions 913 and 923. When the electrical connector is miniaturized, electrostatic capacitance between the facing parts becomes nonnegligible because a gap between the first and second contact pieces 910 and 920 becomes narrow. This electrostatic capacitance is directly connected to the deterioration of transmission characteristics of the electrical connector.

By the way, the electrical connector of the type such as the conventional electrical connector 900 is standardized so that characteristic impedance meets 100Ω±15% for example. Therefore, the electrostatic capacitance between the adjacent contact pieces must be reduced as less as possible also to improve a yield ratio conforming to the standard.

Meanwhile, because the cutout portions 115*c* of the first contact pieces 110 and the cutout portions 125*c* of the second contact pieces 120 are alternately disposed when the contact supporting body 930 of the electrical connector 100 is seen from the side thereof (see FIG. 10), an area where the body portions of the adjacent contact pieces face in parallel is reduced as compared to the conventional. Because the electrostatic capacitance is proportional to an area where the adjacent contact pieces face each other, the electrostatic capacitance between the adjacent contact pieces may be reduced as compared to the conventional by reducing the area where the body portions of the adjacent contact pieces face each other. Accordingly, because the characteristic impedance is improved, favorable transmission characteristics may be realized.

From this point of view, the rectangular cutout portion 115*c* illustrated in the figure is preferred to have the height equal to or more than the half of the height H3 of the rectangular thin plate portion 115*a*. Similarly, the rectangular cutout portion 125*c* illustrated in the figure is preferred to have the height equal to or more than the half of the height H3 of the rectangular thin plate portion 125*a*. In addition, this invention is not limited to provide the cutout portions 115*c* and 125*c* so that they are disposed alternately in the upper and lower sides like the first embodiment. That is, it will do if the cutout portions are alternately disposed so that the facing area of the body portions of the adjacent contact pieces is reduced, so that the cutout portions 115*c* and the cutout portions 125*c* may be provided so that they are disposed forward and backward alternately in the longitudinal direction of the contact pieces.

<Assembling Contact Supporting Body with Lead Supporting Body>

Figure 11:
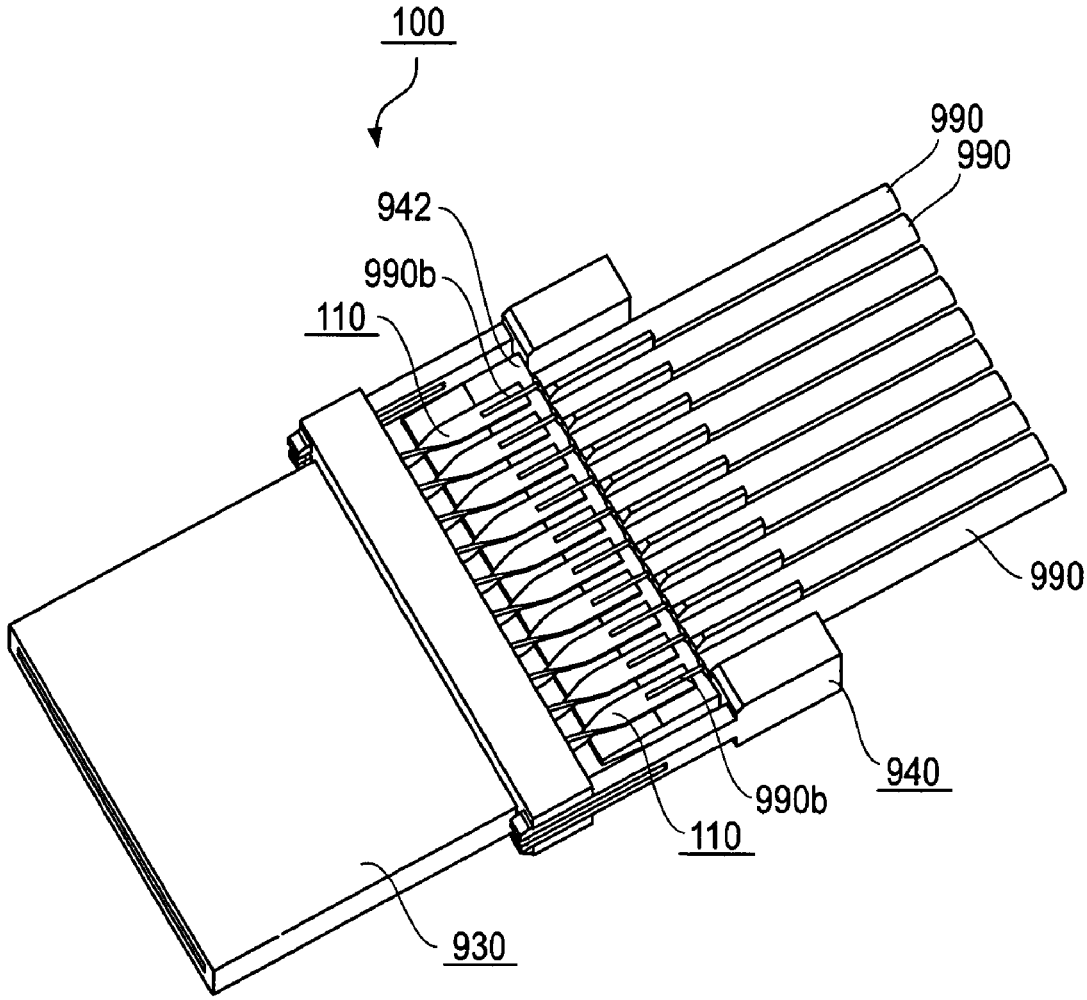
FIG. 11 is a perspective view of an electrical connector of the first embodiment of the invention.

The lead supporting body 940 is assembled into the contact supporting body 930 as shown in FIG. 11. The clip portions 943 of the lead supporting body 940 fit into the concave portions 932*b* of the contact supporting body 930 and the catch portions 943*b* of the lead supporting body 940 catch on the slot forming portion 932 due to elasticity of the clip portions 943. It prevents the lead supporting body 940 from being disengaged from the contact supporting body 930. In the state in which the lead supporting body 940 is assembled with the contact supporting body 930, the leg portions 113 of the first contact pieces 110 are placed upon the upper surface of the table portion 942 of the lead supporting body 940 and leg portions 123 of the second contact pieces 120 are placed under the under surface (not shown in FIG. 11) of the table portion 942 of the lead supporting body 940. Leads 990 are fitted into the grooves 941*a* of the lead holding portion 941, each of the grooves 941*a* holds one lead 990. The unwrapped core portion 990*b* of each lead 990 is soldered to the leg portion 113 or 123 corresponding to the groove 941*a*.

This invention is not limited to a mode that embodies the respective technological features that: 1) each contact piece has the cutout portion; 2) each contact piece has the structure in which the leg portion thereof is twisted by 90 degrees with respect to the body portion; and 3) the width in the direction vertical to the direction in which the electrical signal advances through the contact piece is constant. A mode embodying at least either one of these technological features may be also allowed.

Second Embodiment

An electrical connector of a second embodiment of the invention has the first contact pieces 110, the second contact pieces 120, the contact supporting body 230 and a lead supporting body 940. The first and second contact pieces 110 and 120 have the structures explained in the first embodiment and the lead supporting body 940 has the same structures with that explained in the Background of the Invention, so that their explanation will be omitted here. The same components will be denoted by the same reference numerals and their explanation will be also omitted here.

Figure 12:
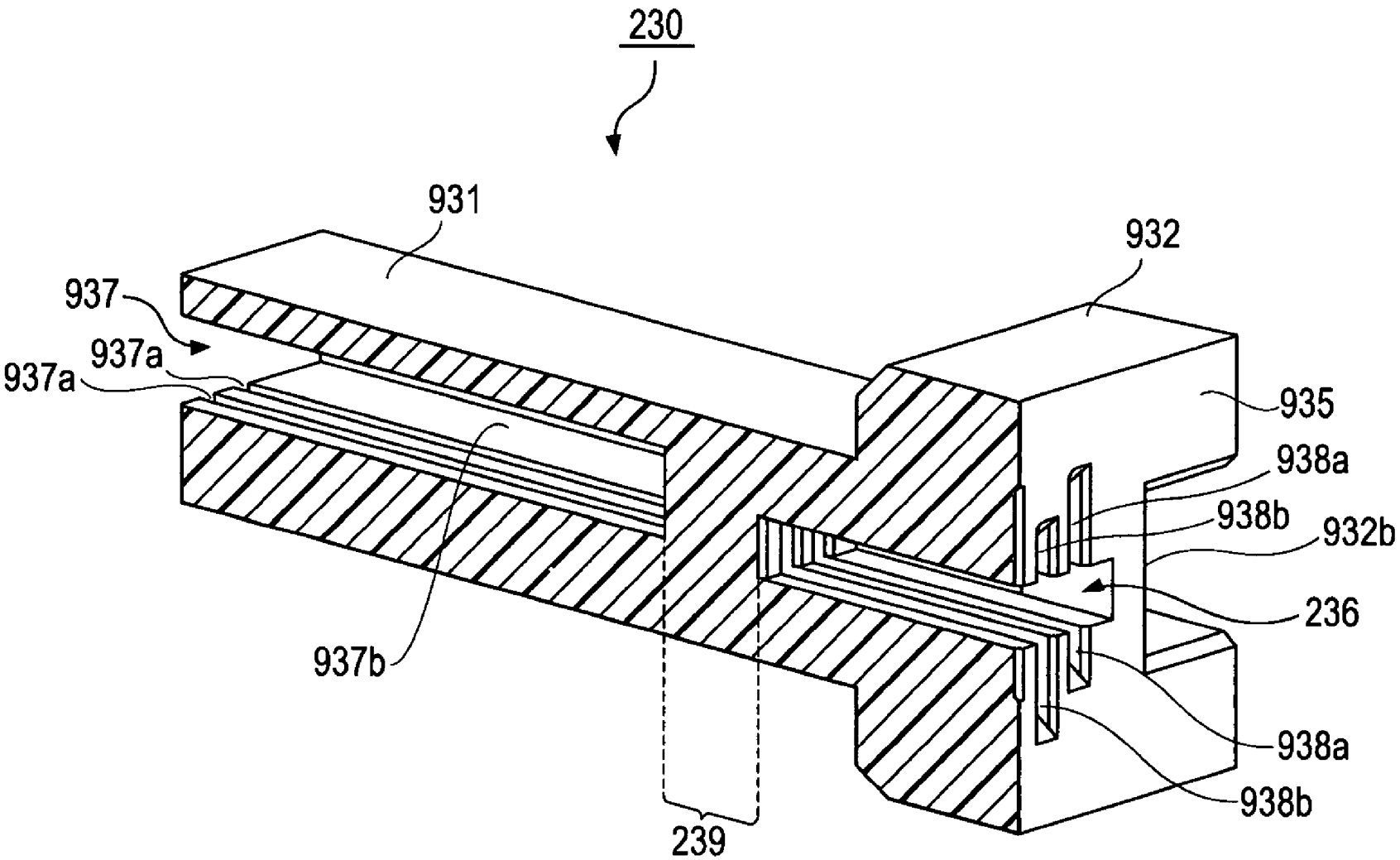
FIG. 12 is a sectional perspective view of a contact supporting body included in an electrical connector of a second embodiment.

The contact supporting body 230 formed of a single piece is different from the contact supporting body 930 used in the first embodiment in the following points. Although the inner wall portion 939 isolates the body portions of the adjacent contact pieces in the contact supporting body 930, the inner wall portion 939 is modified to an inner wall portion 239 whose width is narrow as shown in FIG. 12 in the contact supporting body 230 of the second embodiment. The width of the inner wall portion 239 is a minimum required width for partitioning the respective contact pieces. Preferably, the width of the inner wall portion 239 is a width of a boundary area between the arm portion 112 or 122 and the body portion 111 or 121. That is, the inner wall portion 239 divides the boundary area of the arm portion 112 and the body portion 111 of the first contact piece 110 and the boundary area of the arm portion 122 and the body portion 121 of the second contact piece 120. It is noted that because the width of the inner wall portion 239 is narrowed, the depth of the gap portion 236 is extended more than that of the conventional.

By the way, the electrostatic capacitance between the adjacent contact pieces is proportional to permittivity of a material between the contact pieces. Synthetic resin is mainly adopted as a material of the contact supporting body 230. Relative permittivity $\epsilon_r$ of such synthetic resin is around 2 to 7 and is larger than that of air (about 1). Note that the permittivity may be obtained by multiplying the relative permittivity with permittivity of vacuum. Because the narrow inner wall portion 239 divides between the contact pieces, an area between the contact pieces divided by air increases more than that of the conventional. That is, the electrostatic capacitance between the adjacent contact pieces is smaller than that of the conventional. Accordingly, the characteristic impedance is improved, realizing the favorable transmission characteristics.

It is noted that extending the depth of the gap portion 236 more than that of the conventional means that part intruding into a void of a die used for molding the contact supporting body 230 is extended. This extended part plays a role of reinforcing the part of the die for forming the respective slots.

Third Embodiment

An electrical connector of a third embodiment of the invention has the first contact pieces 110, the second contact pieces 120, the contact supporting body 230 and a lead supporting body 340. The first and second contact pieces 110 and 120 have the structures explained in the first embodiment and the contact supporting body 230 has the same structures with that explained in the second embodiment, so that their explanation will be omitted here. The same components will be denoted by the same reference numerals and their explanation will be also omitted here.

Figure 13:
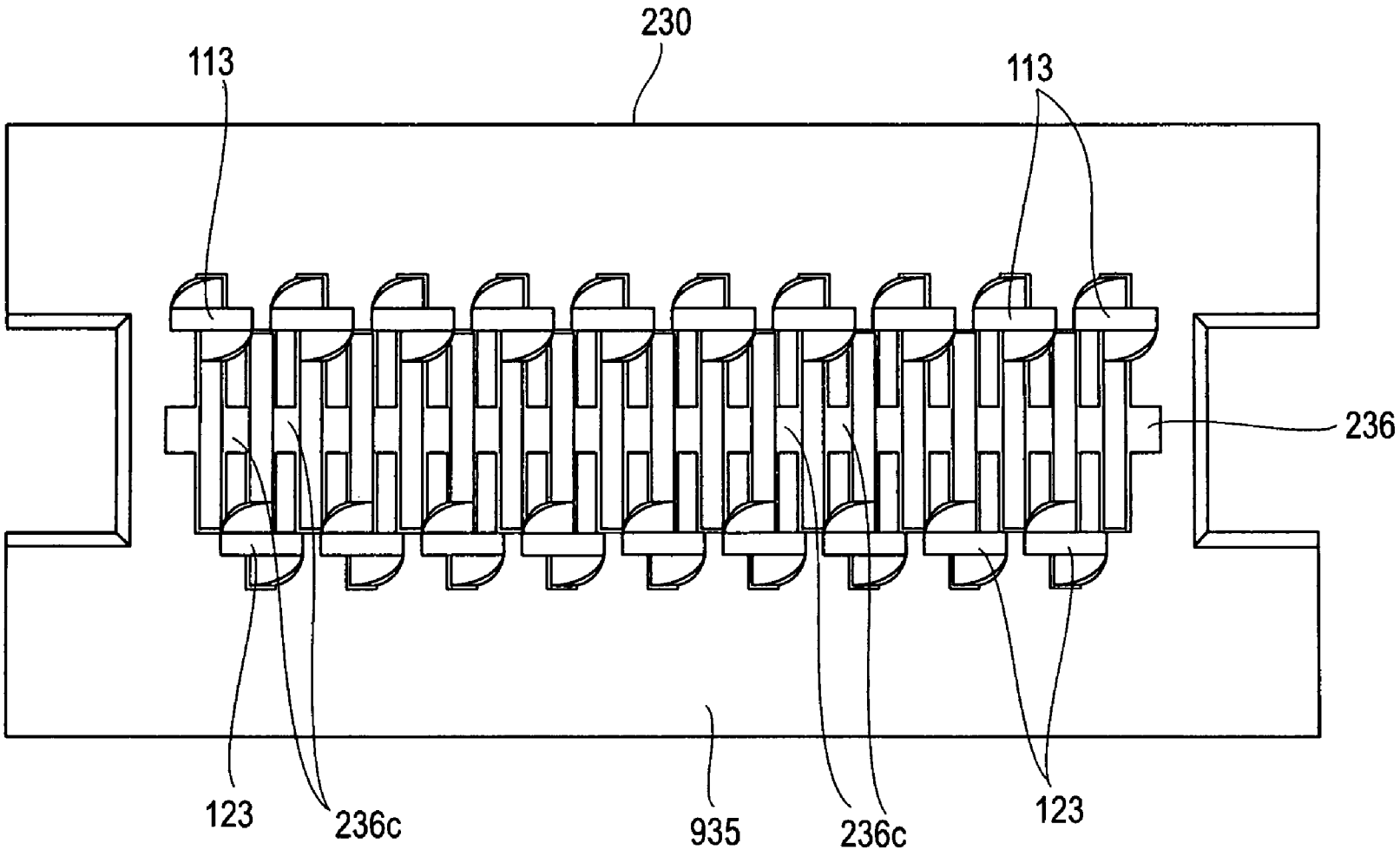
FIG. 13 is a front view of a slot forming surface in a state in which the first and second contact pieces are inserted into the contact supporting body included in an electrical connector of a third embodiment of the invention.

In the state in which the first and second contact pieces 120 are inserted into the contact supporting body 230, as shown in FIG. 13, the gap portions 236 remain opened except of the parts into which the contact pieces are inserted (see the gap portions 236*c* in FIG. 13).

The reduction of the electrostatic capacitance between the contact pieces has been realized by increasing the gap portion within the contact supporting body 230 in the second embodiment described above. However, when a resin cover 710 is formed over the electrical connector of the second embodiment by overmolding (see FIGS. 18A, 18B and 18C), the synthetic resin flows into the inside of the contact supporting body 230 from the opened gap portions 236, filling the gap portions assured to reduce the electrostatic capacitance.

Figure 14:
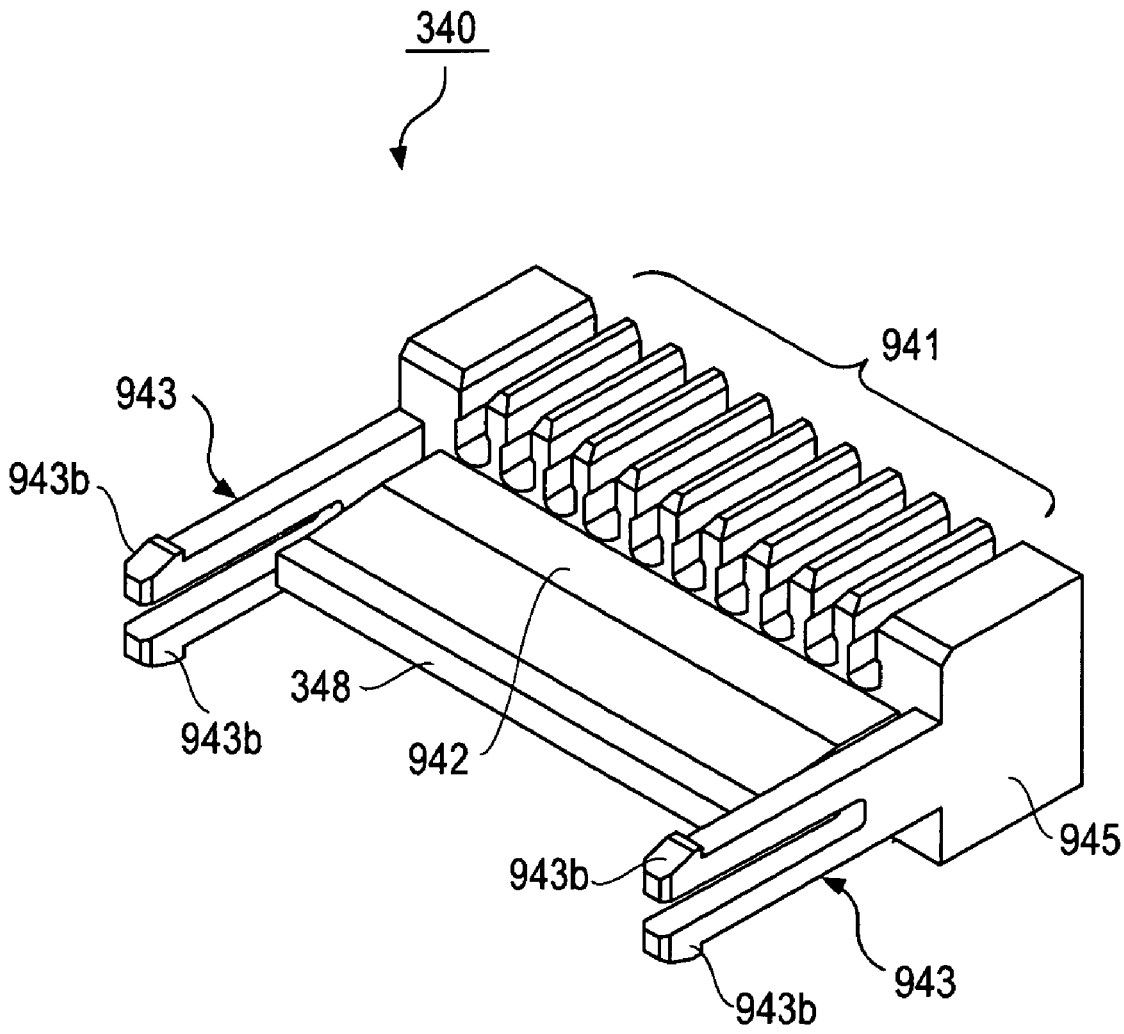
FIG. 14 is a perspective view of a lead supporting body included in the electrical connector of the third embodiment.

Then, the lead supporting body 340 is provided with a block portion 348 that occludes the gap portions 236 in a state in which the lead supporting body 340 is assembled with the contact supporting body 230. As shown in FIG. 14, the rectangular parallelepiped block portion 348 is integrally attached to an end portion of the table portion 942 extending in the extension direction of the clip portion 943.

Figure 15:
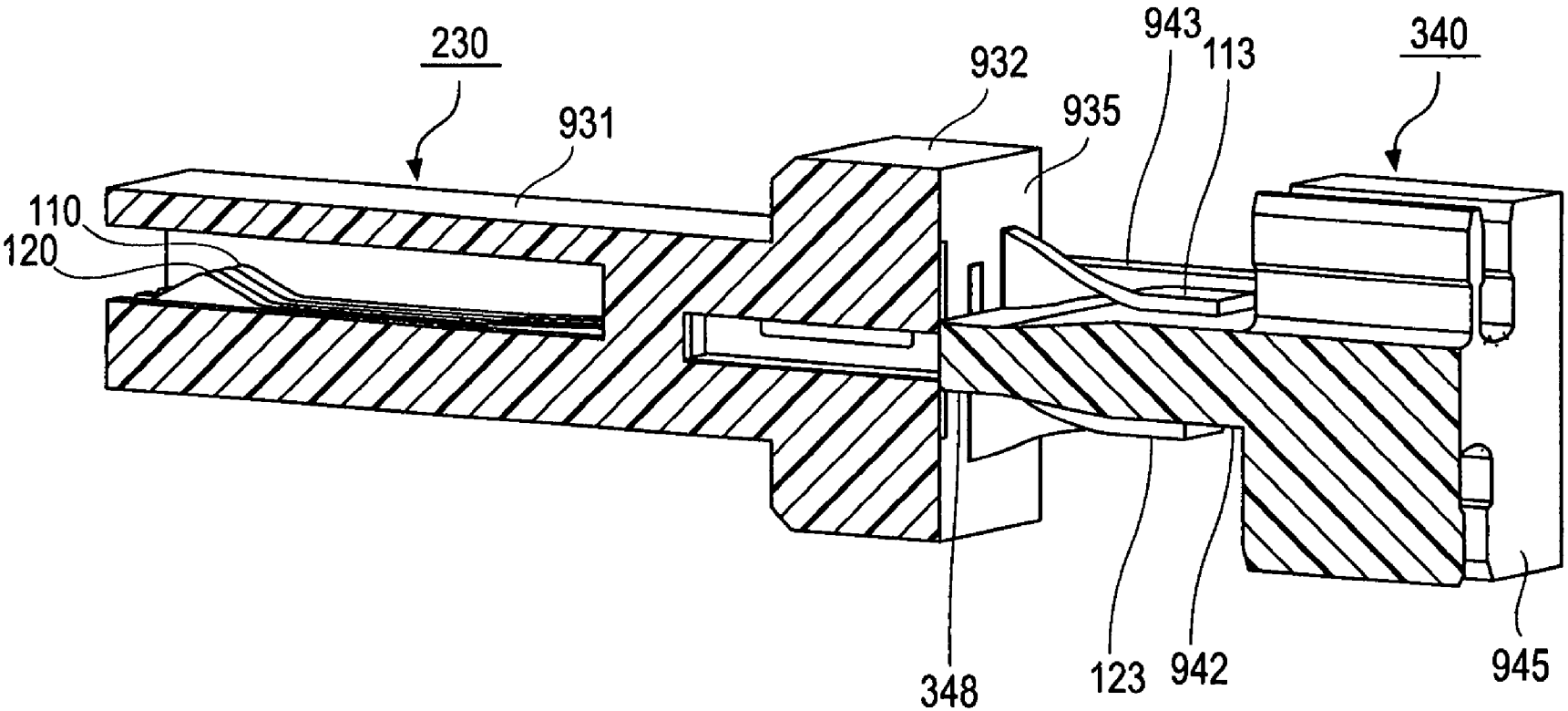
FIG. 15 is a sectional perspective view of the electrical connector of the third embodiment.

The block portion 348 occludes the gap portion 236 as shown in FIG. 15 in the state in which the lead supporting body 340 is assembled with the contact supporting body 230. It is noted that in the state in which the first and second contact pieces 110 and 120 are inserted into the contact supporting body 230, the short side portion 115*k* of the rectangular thin plate portion 115*a* and the short side portion 125*k* of the rectangular thin plate portion 125*a* are positioned in a plane including the slot forming surface 935.

It is possible to suppress the synthetic resin from flowing into the gap portion within the contact supporting body 230 by occluding the gap portion 236. Because the gap portion within the contact supporting body 230 is assured after forming the resin cover 710, the effect of reducing the electrostatic capacitance is sustained.

Fourth Embodiment

It is necessary to arrange connecting parts, in each of which the leg portion of each contact piece connects with the lead, densely as much as possible to miniaturize the electrical connector. However, there has been a possibility that the connecting parts contact each other to short out on the table portion 942 with the structure of the lead supporting body 940. Then, an electrical connector of a forth embodiment of the invention is provided with a lead supporting body 440.

Figure 16:
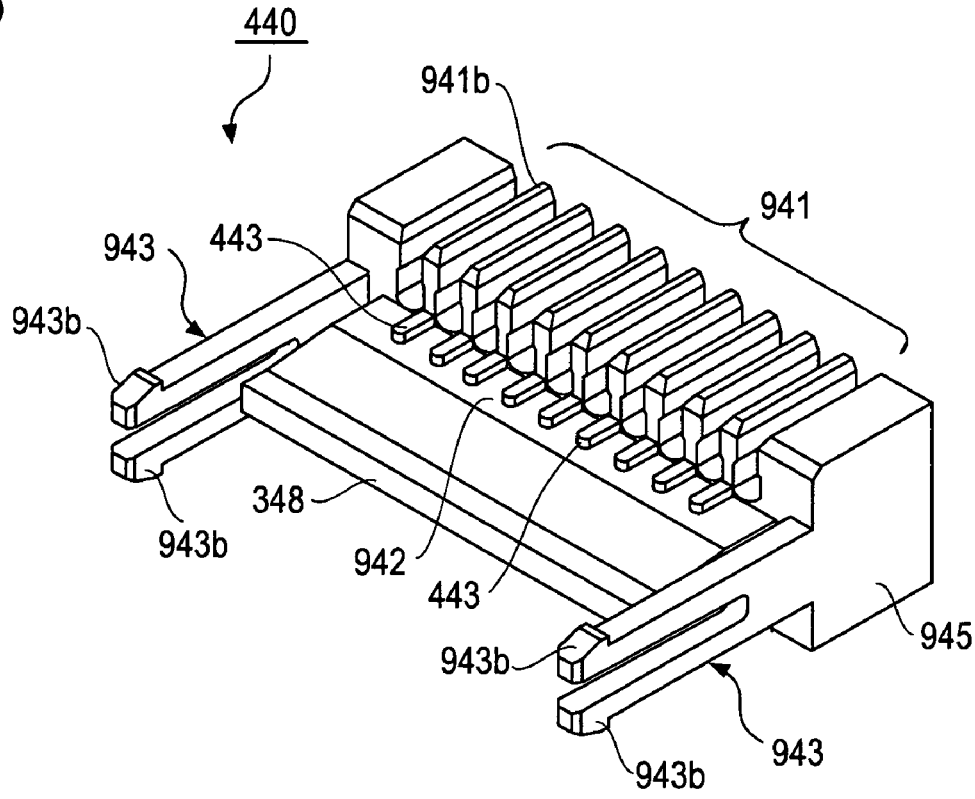
FIG. 16 is a perspective view of a lead supporting body included in an electrical connector of a fourth embodiment of the invention.

As shown in FIG. 16, the lead supporting body 440 is provided with a plurality of divider portions 443 for separating the leg portions so that the adjacent leg portions of contact pieces do not contact each other on the table portion 942. The divider portions 443 of isolation are disposed in front of convex portions 941*b* that are partitions of the grooves 941*a* of the lead holding portion 941 on the table portion 942. In the state in which the lead supporting body 440 is assembled with the contact supporting body 130 or 230, the leg portions 113 or 123 fit in between the adjacent divider portions 443. The leg portions 113 of the first contact pieces 110 are placed on the upper surface of the table portion 942 of the lead supporting body 440 and the leg portions 123 of the second contact pieces 120 are placed under the under surface (not shown in FIG. 16) of the table portion 942. Leads 990 are fitted into the grooves 941*a* of the lead holding portion 941, and each groove 941*a* holds one lead 990. The unwrapped core portion 990*b* of each lead 990 is soldered to the leg portion 913 or 923 corresponding to the groove 941*a*. Thus, the connecting parts will not contact each other to short out because the divider portions 443 are provided.

Fifth Embodiment

Figure 17:
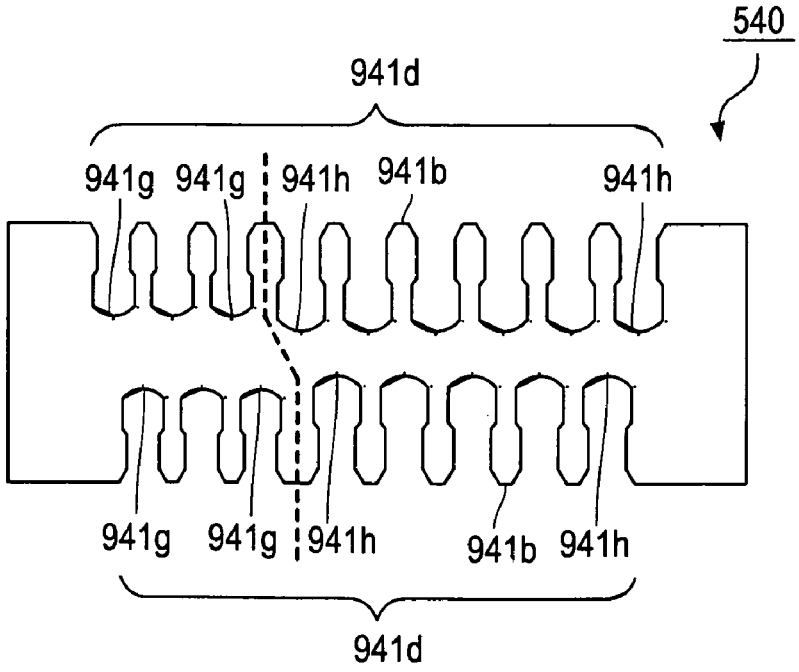
FIG. 17 is a back view of a lead supporting body included in an electrical connector of a fifth embodiment of the invention.

The position of the lead 990 is not stabilized if a width of the corresponding groove 941*a* of the lead holding portion 941 is larger than a diameter of the lead 990. It may cause a trouble in soldering the lead especially when the leads 990 are densely disposed. Then an electrical connector of a fifth embodiment of the invention is provided with a lead supporting body 540. When the leads 990 have two kinds of diameters, the lead supporting body 540 is provided with a lead holding portion 941*d* having two kinds of grooves 941*g* and 941*h* with widths conforming to the diameters of the leads as shown in FIG. 17, instead of the lead holding portion 941. In the example shown in the figure, each groove 941*g* holds the lead 990 having a small diameter and each groove 941*h* holds the lead 990 having a large diameter. It becomes possible to firmly hold the leads 990 and to prevent erroneous wiring by setting the widths of the grooves 941*g* and 941*h* corresponding to the diameters of the leads 990.

Figure 18A:
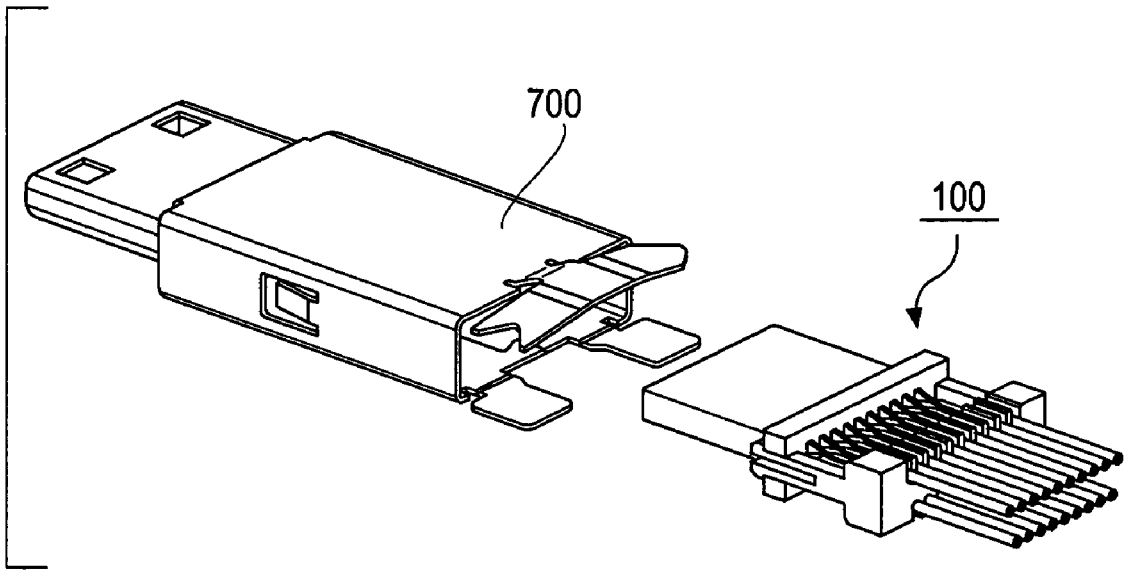
FIG. 18A is a diagram illustrating a state before the electrical connector of the first embodiment is inserted into a metal shield case.
Figure 18B:
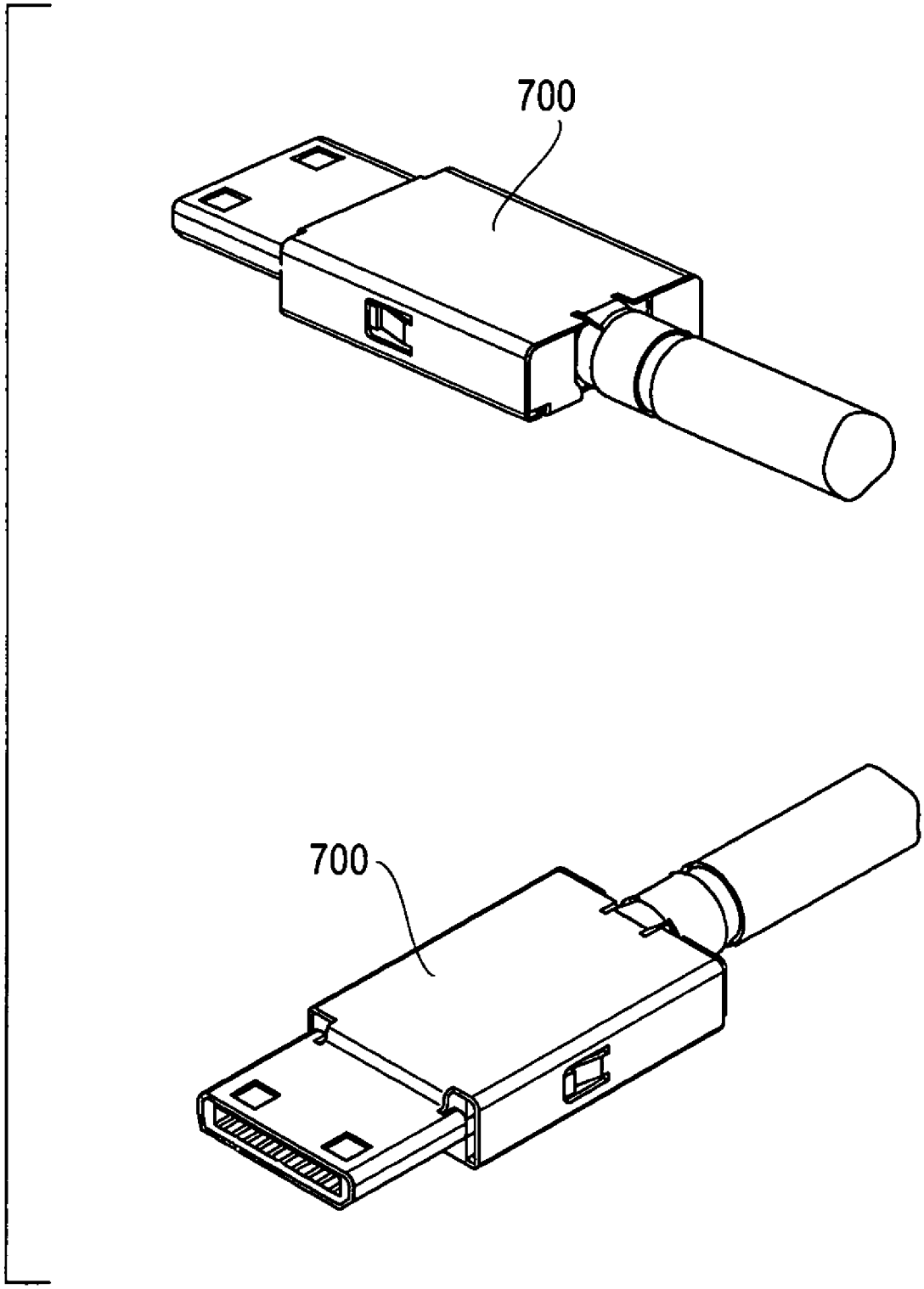
FIG. 18B is a diagram illustrating a state in which the electrical connector of the first embodiment has been inserted into and tightened by the metal shield case.
Figure 18C:
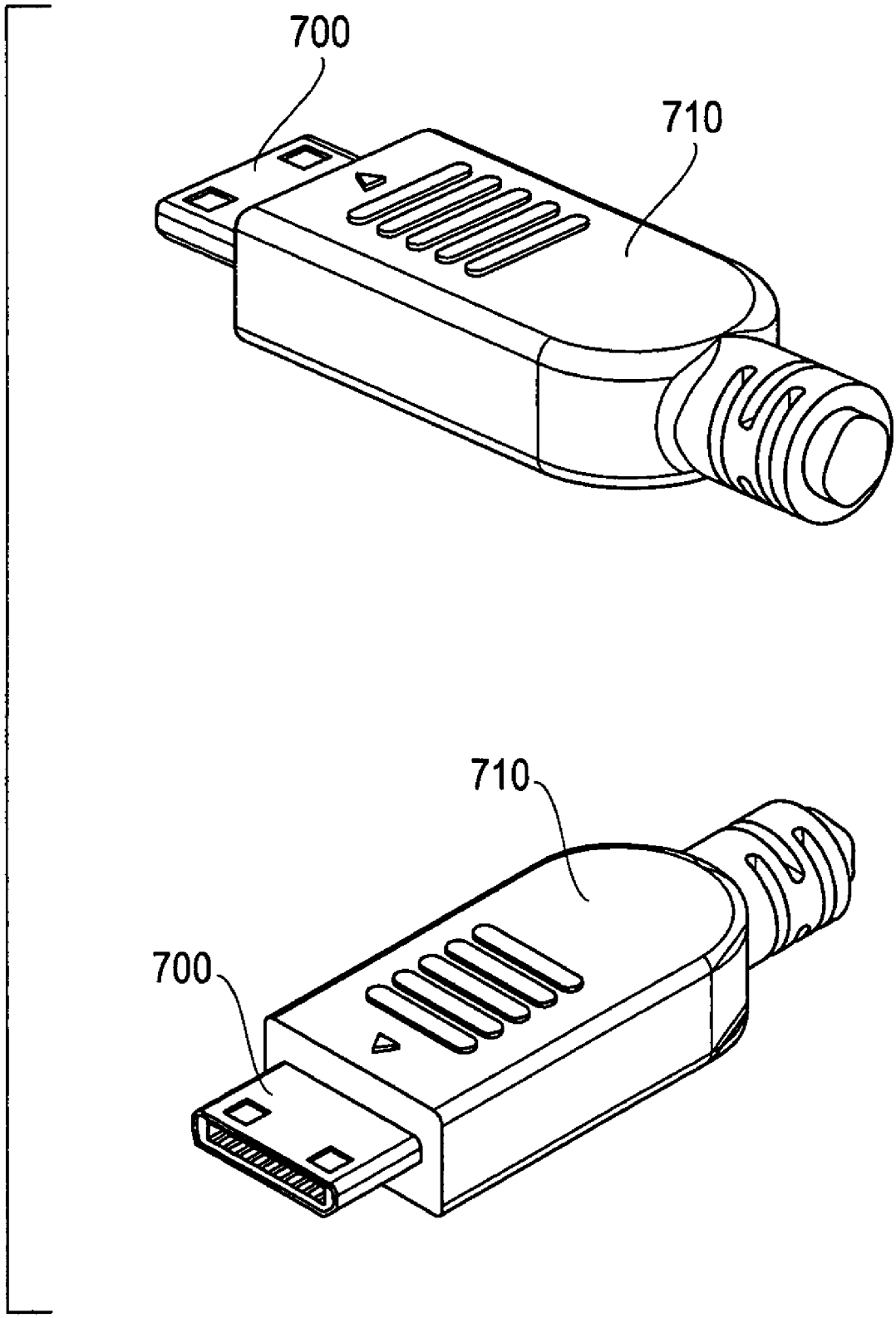
FIG. 18C is a diagram illustrating a plug which is obtained by forming a resin cover over the metal shield case by overmolding.

As shown in FIGS. 18A and 18B, a metal shield case 700 is attached to the electrical connector of each embodiment (the electrical connector 100 of the first embodiment is shown in FIG. 18A) and the resin cover 710 is formed by overmolding as shown in FIG. 18C.

Another side electrical connector that fits into the electrical connector explained in each embodiment may be constructed so as to have the technological features of the electrical connectors of the invention.

The electrical connector of the invention is not limited to the embodiments described above and may be modified appropriately within a scope not departing from the subject matters of the invention. Still more, the invention may be carried out by freely combining the technological features appearing in the abovementioned explanation within a scope not contradicting each other.

The invention is suitable as an electrical connector used for electronic apparatuses, e.g., a high-definition digital television set, that require a small physical interface excelling in the characteristic impedance.

What is claimed is:

1. An electrical connector, comprising:

a plurality of first contact pieces, each including a body portion, an arm portion extending from said body portion and a leg portion extending from said body portion, wherein said body portion of each first contact piece is provided with a first cutout portion;

a plurality of second contact pieces, each including a body portion, an arm portion extending from said body portion and a leg portion extending from said body portion, wherein said body portion of each second contact piece is provided with a second cutout portion;

a contact supporting body for holding said first and second contact pieces alternately in parallel; and a lead supporting body, to be assembled with said contact supporting body, for holding a plurality of leads to be connected with said leg portions of said first contact pieces or said leg portions of said second contact pieces;

wherein said leg portion of each first contact piece is twisted at a right angle with respect to said body portion of said each first contact piece;

said leg portion of each second contact piece is twisted at a right angle with respect to said body portion of said each second contact piece; and said first and second cutout portions of said first and second contact pieces are alternately disposed to reduce an area where the body portions of adjacent contact pieces face each other in a state in which said first and second contact pieces are alternately held in parallel to each other by said contact supporting body.

2. The electrical connector according to claim 1, wherein:

said leg portion of each first contact piece has a shape extending in a longitudinal direction of each first contact piece opposite to said arm portion;

said leg portion of each second contact piece has a shape extending in a longitudinal direction of each second contact piece opposite to said arm portion;

a width of each first contact piece in a direction vertical to a direction in which an electrical signal advances through each first contact piece is constant; and a width of each second contact piece in a direction vertical to a direction in which an electrical signal advances through each second contact piece is constant.

3. The electrical connector according claim 1, wherein:

said first and second cutout portions of said first and second contact pieces are disposed alternately in upper and lower sides of the body portions in a direction vertical to the longitudinal direction of said first or second contact piece.

4. The electrical connector according to claim 1, wherein said first and second cutout pieces of said first and second contact pieces are disposed alternately forward and backward in the longitudinal direction of said first or second contact piece.

5. An electrical connector comprising:

a plurality of first contact pieces, each including a body portion, an arm portion extending from said body portion and a leg portion extending from said body portion;

a plurality of second contact pieces, each including a body portion, an arm portion extending from said body portion and a leg portion extending from said body portion;

a contact supporting body for holding said first and second contact pieces alternately in parallel, wherein said contact supporting body is provided with a plurality of first slots and a plurality of second slots that are alternatively disposed in parallel at equal intervals and into which said first and second contact pieces are inserted, a gap portion that communicates said first and second slots and a space portion for storing said arm portions of said first and second contact pieces;

a lead supporting body, to be assembled with said contact supporting body, for holding a plurality of leads to be connected with said leg portions of said first contact pieces or said leg portions of said second contact pieces;

wherein said leg portion of each first contact piece is twisted at a right angle with respect to said body portion of said each first contact piece;

said leg portion of each second contact piece is twisted at a right angle with respect to said body portion of said each second contact piece; and an inner wall portion between said space portion and said gap portion separates a boundary area of said arm portion and said body portion of each first contact piece from a boundary area of said arm portion and said body portion of each second contact piece.

6. An electrical connector comprising:

a plurality of first contact pieces, each including a body portion, an arm portion extending from said body portion and a leg portion extending from said body portion;

a plurality of second contact pieces, each including a body portion, an arm portion extending from said body portion and a leg portion extending from said body portion;

a contact supporting body for holding said first and second contact pieces alternately in parallel, wherein said contact supporting body is provided with a plurality of first slots and a plurality of second slots that are alternatively disposed in parallel at equal intervals and into which said first and second contact pieces are inserted, a gap portion that is open and by which said first and second slots communicate with each other and a space portion for storing said arm portions of said first and second contact pieces;

a lead supporting body, to be assembled with said contact supporting body, for holding a plurality of leads to be connected with said leg portions of said first contact pieces or said leg portions of said second contact pieces;

wherein said leg portion of each first contact piece is twisted at a right angle with respect to said body portion of said each first contact piece;

said leg portion of each second contact piece is twisted at a right angle with respect to said body portion of said each second contact piece; and said lead supporting body is provided with a block portion that occludes part of said gap portion opened to an outside in a state in which said lead supporting body is assembled with said contact supporting body.

7. The electrical connector according claim 6, wherein:

said lead supporting body is provided on the table portion with divider portions for separating adjacent leg portions of said first or second contact pieces.

* * * * *